US006939183B2

(12) United States Patent
Ferretti et al.

(10) Patent No.: US 6,939,183 B2
(45) Date of Patent: Sep. 6, 2005

(54) UNIVERSAL BUS BAR CONNECTOR WITH MULTI-PITCH THREADED HOLE

(75) Inventors: Michael John Ferretti, Sciota, PA (US); George Triantopoulos, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 10/885,183

(22) Filed: Jul. 6, 2004

(65) Prior Publication Data

US 2005/0009413 A1 Jan. 13, 2005

Related U.S. Application Data

(60) Provisional application No. 60/486,318, filed on Jul. 11, 2003.

(51) Int. Cl.[7] ..... H01R 11/09
(52) U.S. Cl. ..... 439/798; 439/921
(58) Field of Search ..... 439/797, 798, 439/814, 921

(56) References Cited

U.S. PATENT DOCUMENTS 4,917,615 A * 4/1990 Franks, Jr. ..... 439/98
D309,664 S 7/1990 McGrane
D346,150 S 4/1994 Triantopoulos
5,460,532 A * 10/1995 Leto ..... 439/100
D377,782 S 2/1997 Fillinger
5,690,516 A 11/1997 Fillinger
5,848,913 A 12/1998 Ashcraft
5,931,708 A 8/1999 Annas et al.
6,579,131 B1 * 6/2003 Ashcraft et al. ..... 439/798
6,764,354 B2 * 7/2004 Kaine et al. ..... 439/793
6,769,941 B2 * 8/2004 Norden ..... 439/798

FOREIGN PATENT DOCUMENTS

DE 38 04 291 8/1989

* cited by examiner

*Primary Examiner*—Thanh-Tam Le
(74) *Attorney, Agent, or Firm*—Hoffman & Baron, LLP

(57) ABSTRACT

A connector is attachable to an extending transformer stud. The connector includes an elongate central body having a longitudinal bore opening at one end for insertable accommodation of the transformer stud. The longitudinal bore accepts more than one size stud without increasing the size and cost needed for two separate mounting holes. The connector according to the present invention accepts the pitch of at least two different size threads and with the typical setscrew locking arrangement, maintains thread engagement on one side of the stud, securing the stud and maintaining an electrical contact area between the stud and the connector.

21 Claims, 3 Drawing Sheets

UNIVERSAL BUS BAR CONNECTOR WITH MULTI-PITCH THREADED HOLE

CROSS-REFERENCE TO RELATED APPLICATIONS

This application claims priority to U.S. Provisional Application No. 60/486,318, filed Jul. 11, 2003.

FIELD OF THE INVENTION

The present invention relates generally to a connector for connecting to a transformer having a single stud hole with superimposed multiple threads. More particularly, the present invention relates to a transformer stud connector, having a single threaded hole, which permits the connector to install studs of different sizes.

BACKGROUND OF THE INVENTION

Electrical transformers are typically used to distribute electrical power from main utility lines for secondary distribution. The transformer accepts the main utility line on the primary side of the transformer and distributes the power from a secondary side of the transformer. An electrical step-down is provided by the transformer so as to provide for the proper secondary distribution of electrical power for residential and commercial use.

The transformer is normally housed in a steel cabinet. A threaded copper stud extends from the secondary side of the transformer from which secondary distribution is provided. Plural electrical conductors, connected to the threaded stud, provide for distribution of power to the end user.

In order to connect the conductor to the stud, a transformer stud connector is employed. These transformer stud connectors are elongate, electrically conductive members which are inserted over the copper stud extending from the secondary side of the transformer. The stud connector may be threadingly attached to the transformer stud. Extending longitudinally therefrom are a plurality of conductor accommodating ports wherein the ends of conductors may be inserted. Each conductor port has an associated set screw to effect mechanical and electrical connection to the transformer stud connector. Examples of transformer stud connectors are shown in U.S. Pat. Nos. 5,931,708; 5,848,913; 5,690,516; DES 377,782; DES 346,150; and DES 309,664.

In a typical arrangement, the utility distribution transformer has threaded studs typically ⅝–11 or 1–14, oversized applications can have larger 1¼–12, 1½–12 threaded studs or possibly a custom size dictated by customer needs. A connector, sometimes referred to as a bus bar, is used to connect to the stud and provide ports for multiple wire connections. The connector is threaded with the same pitch tread but the threaded hole is equal or larger to the diameter of the transformer stud. This allows the connector to be slipped on to the stud, known as a slip fit connector, instead of being spun onto the treaded shaft. This allows the connector to be installed and removed without having to remove any of the conductors. An orthogonally mounted setscrew is typically used to secure the connector to the studded shaft.

In prior art connectors, various means were provided so that a single connector could be used to service studs of various sizes. One way is to provide at least two threaded holes, one for each of the stud sizes serviced by the connector. However, the disadvantage of such design is that it requires at least two holes, and therefore needs to be larger than necessary. Also, because by design the stud hole has to meet a certain depth to accommodate the stud, the portion of the connector receiving the threaded stud in not usable for conductor connections, thus additionally requiring a longer connector to accommodate an equal number of conductors. This problem is exacerbated for connectors having multiple threaded holes.

A further prior art design utilizes a tear-drop design of two holes which overlap and therefore produce a large diameter threaded hole having an arc-section of a smaller hole at the bottom of the larger hole, which extends beyond the perimeter of the larger hole. This design is commonly known as the "tear-drop" design. The disadvantage of this design is that it requires pre-drilling a smaller hole, followed by drilling of the second larger hole, partially overlapping the smaller hole. Alternately, the larger hole can be bored first, followed by milling or broaching of the bottom arc section to create the "tear-drop". Both methods therefore require a two-step process, which adds complexity and expense to the manufacturing process.

A third alternative prior art design utilizes a slider system mounted to the connector which has grooved sides at various levels on the connector body. By moving the slider, in the grooves, various gap sizes between the slider and the connector body can be formed. However, this design requires a second element, the slider, to be added to the connector, which adds complexity and expense to the manufacturing process.

It is therefore desirable to provide a transformer stud connector, which can be mounted on studs of various sizes without the complexity, or cost of prior art designs and which has a more compact design.

SUMMARY OF THE INVENTION

The present invention provides a connector, which can be attached to transformer studs of various sizes with a single threaded hole.

The present invention therefore provides a connector for attachment to an extending transformer stud. The connector includes an elongate central body having a longitudinal bore, opening at one end for insertable accommodation of the transformer stud. The longitudinal bore accepts more than one size stud without increasing the size and cost needed for two separate mounting holes. The connector according to the present invention accepts the pitch of at least two different size threads and with the typical setscrew locking arrangement, maintains thread engagement on one side of the stud, securing the stud and maintaining electrical contact area between the stud and the connector.

It is well known in the art to create threads for fastening and other applications typically by tapping or machining the proper size thread (male or female) according to the various thread standards/classes applicable. The threads are typically uniform in shape/profile throughout the threaded length of the part bearing threads. The threads are made to work with same size and type threads of a complementary part.

The present invention uses a single hole or bore within the body of a connector to accept two or more threaded studs of different thread sizes. This is accomplished in the present invention by using the principle of superposition (overlaying) of the desired threads and pitches to provide for a resulting threaded section, which allows two different size threaded studs to be firmly interlocked within the threaded hole. In other words, the present invention provides for partial or complete thread distortion on a pre-existing thread by removal of thread sections, which correspond to the size, and pitch of a second thread.

To that end there is provided an electrically conductive transformer stud connector comprising a body with a longitudinal cylindrical bore having at least two different size threads overlapped upon each other within the longitudinal cylindrical bore for receiving a transformer stud wherein the longitudinal cylindrical bore is in communication with at least one set screw port wherein the set screw port is aligned orthogonally with the longitudinal cylindrical bore and having a set screw threadedly received therein for exerting a clamping force upon the transformer stud, and a plurality of conductor ports for receiving a conductor, aligned perpendicularly to the longitudinal cylindrical bore along the body, each conductor port being in communication with a set screw port wherein the set screw port is aligned orthogonally with the conductor port and having a set screw threadedly received therein for exerting a clamping force upon the conductor.

The present invention further provides a method of making an electrically conductive transformer stud connector comprising forming a cylindrical longitudinal bore within a connector body, forming a first threaded region corresponding to a predetermined thread size and pitch, forming a second threaded region overlapping the first threaded region corresponding to a second predetermined thread size and pitch wherein the first threaded region and the second threaded region overlap along a single line of tangency.

As shown by way of a preferred embodiment herein, the connector of the present invention includes a smaller diameter thread that appears to cross and overlap the larger thread.

DETAILED DESCRIPTION OF THE PREFERRED EMBODIMENT

Figure 1:
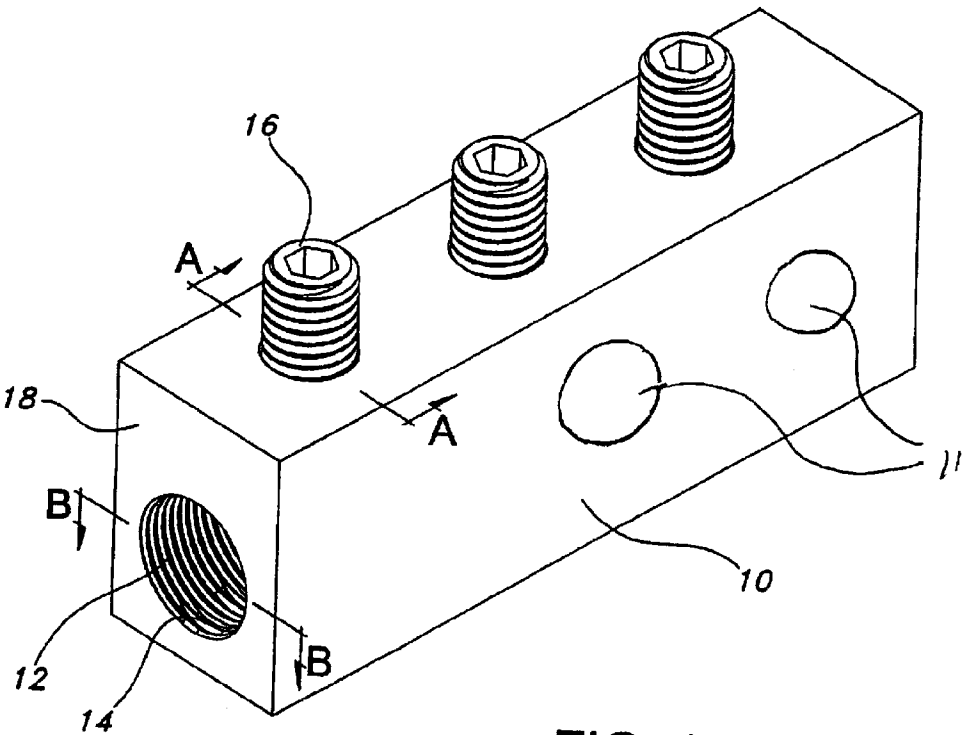
FIG. 1 is a perspective view of a portion of the connector according to the present invention.

Referring to FIG. 1, there is shown a perspective view of the connector according to the present invention. Shown is connector body 10, longitudinal bore 12, having threads 14 disposed along the inner diameter, and set screws 16, protruding from the top of connector body 10 and which can be screwed into connector body 10 to contact transformer stud (not shown). There is further shown side surface 18 of the connector body, which, when mounted to a transformer stud faces the transformer. The connector body 10 is an integrally formed metallic member, preferably formed of aluminum or other material, having high electrical conductivity. Transformer stud connector body 10 includes central, generally elongate cylindrical bore 12. The central bore 12 is internally threaded to accommodate the extending, externally threaded transformer stud (not shown). The length of bore 12 need only be approximately the length of the extending portion of the stud so that when the body is placed over the stud, the stud and the bore extend generally the same distance.

Transformer stud connector body 10 will typically include conductor-accommodating ports 11 for receiving conductors. Each conductor port 11 will also include a securement device such as a setscrew 16 for securing the conductor. Each setscrew aperture is in communication with the respective conductor receiving port so that setscrews may be inserted therein to mechanically and electrically secure the ends of the conductors within the stud connector body 10. In a typical arrangement, each of the ports 11 extends from one side surface of the connector body 10. The conductor ports 11 are generally positioned on similarly facing surfaces so that conductors inserted into the ports 11 can be inserted from the same direction.

Figure 2:
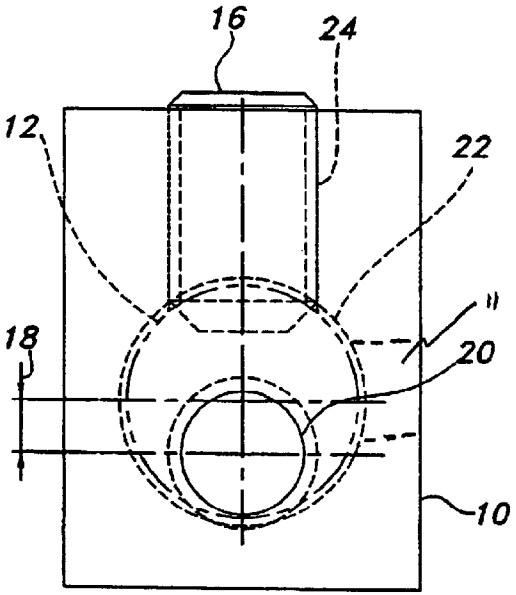
FIG. 2 is a cross-sectional drawing of a connector according to the present invention.

Referring now to FIG. 2, there is shown a lateral cross-sectional view, along cross section A—A of FIG. 1, of the connector according to the present invention. The transformer stud connector body 10 is depicted as having a substantially rectangular exterior shape, with a longitudinal bore 12. The longitudinal bore is comprised of a small diameter threaded region 20 and a large diameter threaded region 22. The central axis of the small diameter threaded region 20 and the large diameter threaded region 22 are offset within the longitudinal bore by a linear distance, which is variable depending on the diameter of each region. Additionally, the connector includes a setscrew 16 for securing the connector to the threaded stud. The setscrew is received into the connector body in a threaded bore 24 and can thus be raised or lowered by rotating the setscrew. In this way, the setscrew can be adjusted to contact a threaded stud within longitudinal bore 12. In a preferred embodiment of the present invention, the connector is produced by forming the longitudinal bore by drilling into the connector body 10 to create a void. Thereafter, a first tap operation is performed to form the small diameter threaded region, which in the preferred embodiment may be a $\frac{5}{8}$–11 thread. Once the small diameter threaded region 20 is formed, a second tap operation is performed to form the large diameter threaded region 22, which in the preferred embodiment may be $1\frac{1}{16}$–14 thread. The threaded regions are positioned within the connector body by offsetting the maximum diameters of the threads to be machined creating a tangency point or line of tangency 26 directly opposite the setscrew, providing a single line of tangency, in a three dimensional frame of reference, along the two thread pitches.

Removal of the overlapping thread sections could be done by a milling/threading/tapping operation on the side of longitudinal bore 12 where interlocking of the second stud is desired, typically opposite the setscrew. Alternately, the overlapping thread sections can be formed at other locations around the entire inner diameter of longitudinal bore 12.

In the preferred embodiment, the contact surface between the threaded stud and the threaded hole is maximized by tapping the threads with 75% class 3 thread. Additionally, specially cut taps can be utilized to produce a variety of thread types supplying the proper thread profile for contact surface maximization.

While the preferred embodiment of the connector according to the present invention is described with respect to a particular large and small thread pitch. It would be clear to one skilled in the art that any standard or non-standard thread pitches could be overlapped in the manner described. Likewise the present invention need not be limited to overlapping two particular thread pitches, but may include more than two particular thread pitches that are formed within longitudinal bore 12.

Figure 3:
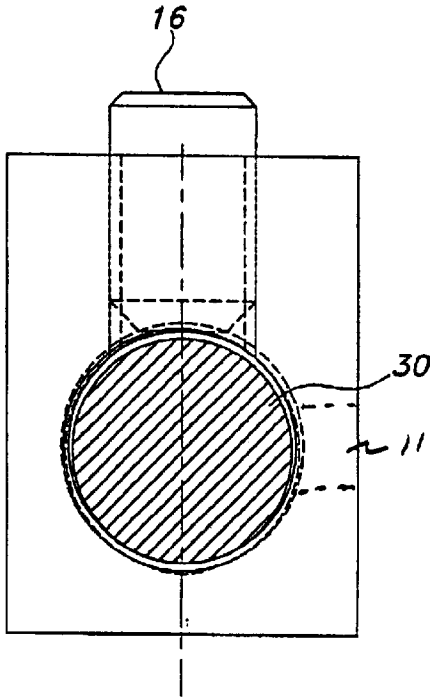
FIG. 3 is a cross-sectional drawing of a connector according to the present invention having a stud installed.

Turning now to FIG. 3, there is shown a cross-sectional view of the connector according to the present invention along cross section A—A of FIG. 1. In this view there is shown a transformer stud 30 installed within longitudinal bore 12, which has a diameter slightly smaller than longitudinal bore 12, such that the connector can be slipped over stud 30 without the stud and connector threads becoming engaged. Once the stud is fully inserted within the connector, setscrew 16 is rotated to bear against stud 30, thereby causing the threads on stud 30 to engage the complementary pitch threads within longitudinal bore 12 and thus secure the connector to the stud. It should be noted that while a standard flat tip set screw is depicted, to minimize thread distortion, a saddle typed stud clamping screw can be used. The saddle type screw utilizes a saddle piece featuring the same type of thread pattern to allow for normal fit over the stud thread, therefore avoiding any thread damage and providing a more positive mechanical and electrical connection.

Figure 4:
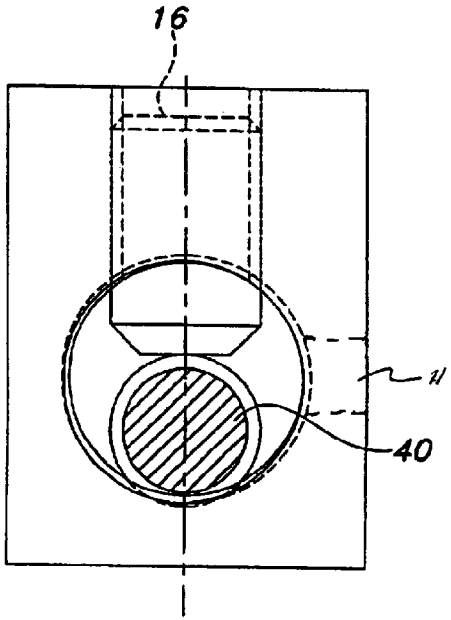
FIG. 4 is a cross-sectional drawing of a connector according to the present invention having an alternate stud installed.

Turning now to FIG. 4, there is shown a cross-sectional view of the connector according to the present invention along cross section A—A of FIG. 1. In this view there is shown a transformer stud 40 installed within longitudinal bore 12, which has a diameter smaller than longitudinal bore 12, such that the connector can be slipped over stud 40 without the stud and connector threads becoming engaged. Once the stud is fully inserted within the connector, setscrew 16 is rotated to bear against stud 40, thereby causing the threads on stud 40 to engage the complementary pitch threads within longitudinal bore 12 and thus secure the connector to the stud. Stud 40 engages the small diameter threaded region of longitudinal bore 12 which are overlapped with the large diameter threads that are engaged by stud 30 of FIG. 3.

Figure 5:
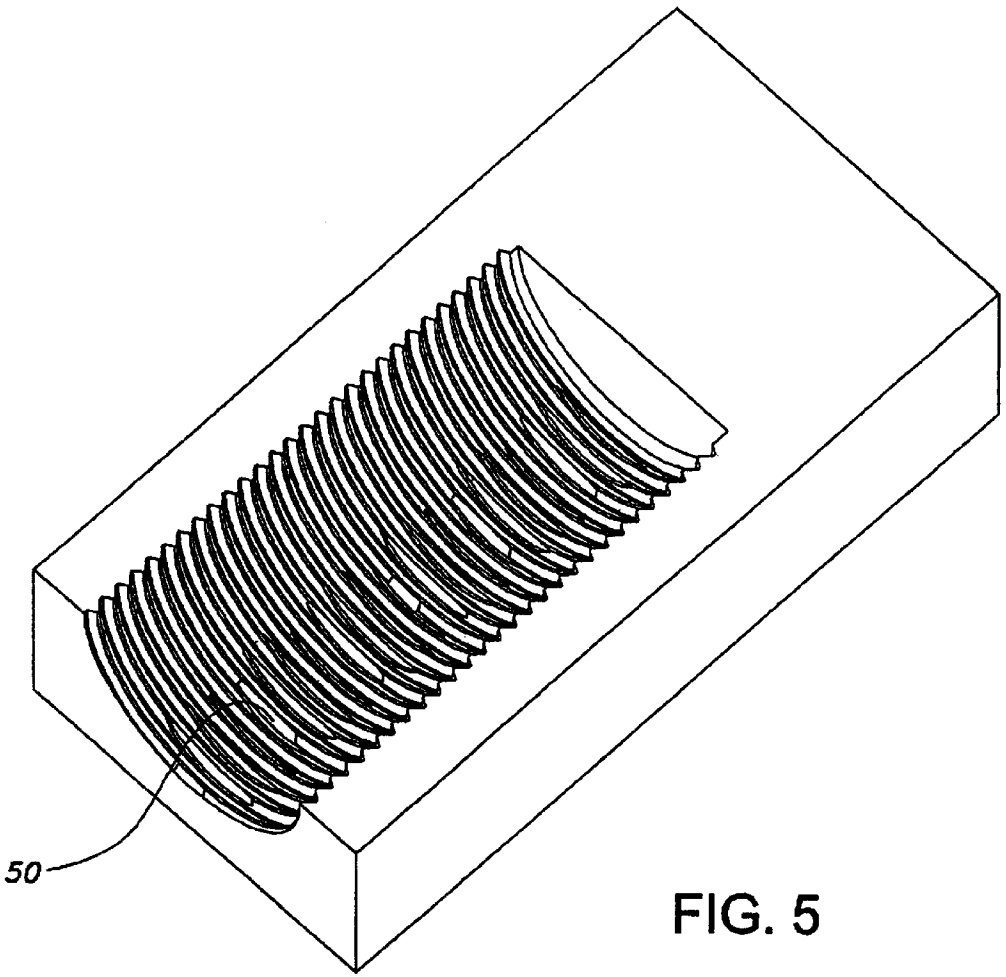
FIG. 5 is a cross-sectional drawing of the threaded hole of the connector according to the present invention depicting the thread arrangement.

Turning now to FIG. 5, there is shown a longitudinal cross section along section B—B depicted in FIG. 1. As shown in FIG. 5, the threads are machined into connector body 10 to create a series of tangency points 26 directly opposite setscrew 16, to provide a line of tangency along the two thread pitches. Viewing FIG. 5, there is shown a swipe or overlapped thread region of the smaller diameter thread that appears to cross the larger thread. In the embodiment described, the −11 thread swipes over the −14 thread. In this way clearance and engagement room is provided the larger 1−14 stud but also allows the ⅝−11 stud to engage at the bottom of the longitudinal bore without the need for a separate machined hole. The difference in pitch will not allow the −11 thread to engage the −14 thread thus the −11 "seeks" the necessary clearance to engage properly. The swipe or overlapped thread allows the −11 thread to engage a specific area only, also providing stability when the setscrew is tightened.

In the preferred embodiment the thread pitches machined into longitudinal bore 12, should differ by at least a factor of two, for example −11 and −13 in order to provide for ease in seating the transformer stud. However, for pitch differences of less than two, the electrical and mechanical bond will be unaffected once seating has been achieved. Furthermore, the concept may be expanded to provide for more than two differing pitches to cross each other allowing more than two different pitch-mounting studs to utilize the same connector longitudinal bore. Additionally a left hand tread may be crossed over a right hand thread of the same or differing pitch.

It will be appreciated that the present invention has been described herein with reference to certain preferred or exemplary embodiments. The preferred or exemplary embodiments described herein may be modified, changed, added to, or deviated from without departing from the intent, spirit and scope of the present invention.

What is claimed is:

1. An electrically conductive transformer stud connector comprising;

a body with a longitudinal cylindrical bore having at least two different size threads overlapped upon each other at a single of line of tangency within said longitudinal cylindrical bore for receiving a transformer stud, wherein said longitudinal cylindrical bore is in communication with at least one set screw port, wherein said set screw port is aligned orthogonally with said longitudinal cylindrical bore and having a set screw threadedly received therein for exerting a clamping force upon said transformer stud, and a plurality of conductor ports for receiving a conductor, aligned perpendicularly to said longitudinal cylindrical bore along said body, each conductor port being in communication with a set screw port wherein said set screw port is aligned orthogonally with said conductor port and having a set screw threadedly received therein for exerting a clamping force upon said conductor.

2. An electrically conductive transformer stud connector as in claim 1, wherein said at least two different size threads are overlapped around a portion of the circumference of said longitudinal cylindrical bore.

3. An electrically conductive transformer stud connector as in claim 2, wherein said portion of the circumference is about 180 degrees.

4. An electrically conductive transformer stud connector as in claim 2, wherein said portion of the circumference is less than 180 degrees.

5. An electrically conductive transformer stud connector as in claim 2 wherein said portion of the circumference of said longitudinal cylindrical bore is about 60 degrees.

6. An electrically conductive transformer stud connector as in claim 2 wherein said portion of the circumference of said longitudinal cylindrical bore is about 120 degrees.

7. An electrically conductive transformer stud connector as in claim 2 wherein said portion of the circumference of said longitudinal cylindrical bore is about 90 degrees.

8. An electrically conductive transformer stud connector as in claim 1, wherein said at least two different size threads are threaded to cooperatively accept said transformer studs received.

9. An electrically conductive transformer stud connector as in claim 1, wherein said longitudinal cylindrical bore is in communication with a plurality of set screw ports.

10. An electrically conductive transformer stud connector as in claim 1, having no threads around a portion of the circumference of said longitudinal cylindrical bore.

11. An electrically conductive transformer stud connector as in claim 10, having no threads wherein said portion of the circumference is about 180 degrees.

12. An electrically conductive transformer stud connector as in claim 10, wherein said portion of the circumference is less than 180 degrees.

13. An electrically conductive transformer stud connector as in claim 10 wherein said portion of the circumference of said longitudinal cylindrical bore is about 60 degrees.

14. An electrically conductive transformer stud connector as in claim 10 wherein said portion of the circumference of said longitudinal cylindrical bore is about 120 degrees.

15. An electrically conductive transformer stud connector as in claim 10 wherein said portion of the circumference of said longitudinal cylindrical bore is about 90 degrees.

16. A method of making an electrically conductive transformer stud connector comprising forming a cylindrical longitudinal bore within a connector body, forming a first threaded region corresponding to a first predetermined thread size and pitch, forming a second threaded region overlapping said first threaded region corresponding to a second predetermined thread size and pitch wherein said first threaded region and said second threaded region overlap along a single line of tangency, and where said first predetermined thread size and pitch differs from said second predetermined thread size and pitch.

17. A method of making an electrically conductive transformer stud connector according to claim 16 wherein forming a cylindrical longitudinal bore within a connector body, further includes boring set screw receiving ports in communication with said longitudinal bore wherein said set screw receiving ports are aligned orthogonally with said longitudinal bore.

18. A method of making an electrically conductive transformer stud connector according to claim 17 wherein said line of tangency is directly opposite said set screw receiving ports.

19. A method of making an electrically conductive transformer stud connector according to claim 16 wherein forming said first threaded region and said second threaded region is done by a milling operation.

20. A method of making an electrically conductive transformer stud connector according to claim 16 wherein forming said first threaded region and said second threaded region is done by a threading operation.

21. A method of making an electrically conductive transformer stud connector according to claim 16 wherein forming said first threaded region and said second threaded region is done by a tapping operation.

* * * * *